United States Patent [19]

Boesch

[11] 4,093,476

[45] June 6, 1978

[54] NICKEL BASE ALLOY

[75] Inventor: William J. Boesch, Utica, N.Y.

[73] Assignee: Special Metals Corporation, New Hartford, N.Y.

[21] Appl. No.: 753,252

[22] Filed: Dec. 22, 1976

[51] Int. Cl.[2] ..... C22C 19/05

[52] U.S. Cl. ..... 148/32.5; 75/171

[58] Field of Search ..... 75/171, 170; 148/32, 148/32.5, 162

[56] References Cited

U.S. PATENT DOCUMENTS 3,667,938 6/1972 Boesch ..... 75/171

*Primary Examiner*—R. Dean

*Attorney, Agent, or Firm*—Vincent G. Gioia; Robert F. Dropkin

[57] ABSTRACT

A gamma prime strengthened nickel base alloy characterized by good hot corrosion resistance, strength, creep resistance, phase stability and stress rupture life. The alloy consists essentially of, by weight, from 12.0 to 20.0% chromium, from 4.0 to 7.0% titanium, from 1.2 to 3.5% aluminum, from 12.0 to 20.0% cobalt, from 2.0 to 4.0% molybdenum, from 0.5 to 2.5% tungsten, from 0.031 to 0.048% boron, from 0.005 to 0.15% carbon, up to 0.75% manganese, up to 0.5% silicon, up to 1.5% hafnium, up to 0.1% zirconium, up to 1.0% iron, up to 0.2% of rare earth elements that will not lower the incipient melting temperature below the solvus temperature of the gamma prime present in the alloy, up to 0.1% of elements from the group consisting of magnesium, calcium, strontium and barium, up to 6.0% of elements from the group consisting of rhenium and ruthenium, balance essentially nickel.

8 Claims, 1 Drawing Figure

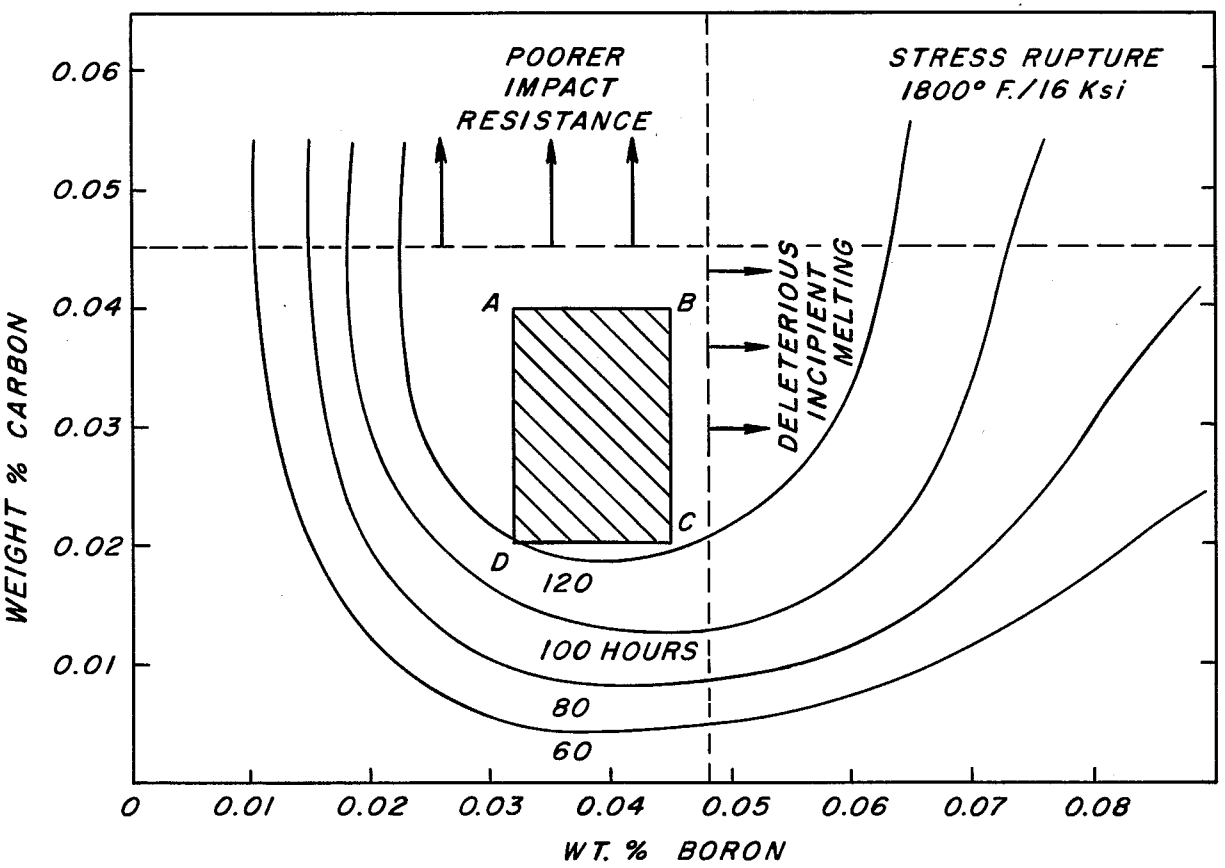
STRESS RUPTURE
1800° F./16 Ksi
DELETERIOUS
INCIPIENT
MELTING
POORER
IMPACT
RESISTANCE
A
B
C
D
120
100 HOURS
80
60
0.06
0.05
0.04
0.03
0.02
0.01
WEIGHT % CARBON
0
0.01
0.02
0.03
0.04
0.05
0.06
0.07
0.08
WT. % BORON

NICKEL BASE ALLOY

The present invention relates to a gamma prime strengthened nickel base alloy.

U.S. Pat. No. 3,667,938 claims an alloy consisting essentially of, by weight, from 12.0 to 20.0% chromium, from 5 to 7% titanium, from 1.3 to 3.0% aluminum, from 13.0 to 19.0% cobalt, from 2.0 to 3.5% molybdenum, from 0.5 to 2.5% tungsten, from 0.005 to 0.03% boron, from 0.05 to 0.15% carbon, balance essentially nickel. Although the alloy has good hot corrosion resistance, strength, creep resistance, phase stability, and most importantly, stress rupture life; its hot impact strength deteriorates at an undesirable rate after long time service at elevated temperatures. U.S. patent application Ser. No. 691,161 filed June 9, 1976 describes an alloy having properties similar to that of U.S. Pat. No. 3,667,938, and yet one of improved hot impact strength. The improvement is attained by lowering the carbon content of U.S. Pat. No. 3,667,938 from a minimum value of 0.05% to a maximum value of 0.045%. Unfortunately, lowering of the carbon content is accompanied by some deterioration in the stress rupture life and hot ductility of the alloy.

Through the present invention there is now provided an alloy with the basic properties of patent application Ser. No. 691,161, and yet one of improved hot ductility and stress rupture life. Improved properties are attained through carefully controlled additions of boron. Unlike the alloys of U.S. Pat. No. 3,667,938 and application Ser. No. 691,161, the alloy of the present invention contains from 0.031 to 0.048% boron.

Other alloys with some similarities to the present invention are disclosed in U.S. Pat. Nos. 2,975,051, 3,385,698 and Re. 28,671. Among other differences, they do not disclose the critical boron content of the subject invention. Likewise, said boron content is not disclosed in the foreign counterparts of U.S. Pat. No. 3,667,938. The counterparts, which differ somewhat from the United States patent, are discussed in greater detail in heretofore referred to patent application Ser. No. 691,161.

It is accordingly an object of the present invention to provide a gamma prime strengthened nickel base alloy.

The foregoing and other objects of the invention will be best understood from the following description, reference being had to the accompanying FIGURE which shows how stress rupture life varies with boron and carbon contents.

The alloy of the present invention is a gamma prime strengthened nickel base alloy characterized by good hot corrosion resistance, strength, creep resistance, phase stability and stress rupture life. It consists essentially of, by weight, from 12.0 to 20.0% chromium, from 4.0 to 7.0% titanium, from 1.2 to 3.5% aluminum, from 12.0 to 20.0% cobalt, from 2.0 to 4.0% molybdenum, from 0.5 to 2.5% tungsten, from 0.031 to 0.048% boron, from 0.005 to 0.15% carbon, up to 0.75% manganese, up to 0.5% silicon, up to 1.5% hafnium, up to 0.1% zirconium, up to 1.0% (preferably less than 0.5%) iron, up to 0.2% of rare earth elements that will not lower the incipient melting temperature below the solvus temperature of the gamma prime present in the alloy, up to 0.1% of elements from the group consisting of magnesium, calcium, strontium and barium, up to 6.0% of elements from the group consisting of rhenium and ruthenium, balance essentially nickel. Exemplary rare earth elements are cerium and lanthanum. The alloy is substantially free of deleterious acicular, sigma and mu phases. Although its predominant use is in the wrought form, it can be used in the cast or powder form.

In addition to the above, a titanium to aluminum ratio of from 1.74:1 to 3.5:1 is imposed upon the subject alloy to help insure the formation of spheroidal gamma prime. Gamma prime which is believed to have the general composition $M_3$ (Al, Ti) gives the alloy its strength. Of the various forms of gamma prime, spheroidal gamma prime is preferred. As used herein the M portion of the gamma prime composition is regarded as consisting mainly of nickel with some substitution of chromium and molybdenum in the approximate proportions, 95 nickel, 3 chromium and 2 molybdenum. Respective minimum aluminum and titanium contents of 1.2% and 4.0% are required to insure adequate strength. For the same reason the total aluminum and titanium content must be at least 6.0%. The total aluminum and titanium content should not, however, exceed 9.0% as too much can hinder workability.

Boron, a critical element in the subject alloy, must be present in an amount of from 0.031 to 0.048%. Stress rupture life deteriorates at a fairly rapid rate at boron levels below 0.031%; and at levels above 0.048%, the alloy is plagued by the onset of deleterious incipient melting, and in turn the deterioration of stress rupture life and other properties. Incipient melting produces voids that, in turn, lower stress rupture life. Moreover, excessive boron can induce at normal regions of complex eutectics, boride-rich areas in large ingots; which areas can cause cracking on cooling of the ingot. Therefore, the effect of boron on stress rupture lives, as depicted in the FIGURE, is most significant. Contour lines shown thereon outline regions where certain stress rupture lives can be expected. For example, an alloy having 0.03 wt.% carbon and 0.040% boron could be expected to have an 1800° F/16 ksi stress rupture life of at least 120 hours. Preferred levels of boron are from 0.032 to 0.045%.

As disclosed in heretofore referred to patent application Ser. No. 691,161, the carbon content of the subject alloy is preferably maintained at a maximum level of 0.045%, and preferably below 0.04%, as impact strength has been found to deteriorate at higher levels. Minimum and minimum preferred carbon levels are respectively 0.005 and 0.01%. A small but finite amount of carbon is necessary to improve hot ductility in the working temperature range and to provide the desired creep resistance at temperatures above about 1500° F.

For the best combination of stress rupture life and impact strength, the alloy of the subject invention preferably has a carbon and boron content within Area ABCD of the FIGURE. Area ABCD is defined by a carbon content of from 0.02 to 0.04% and a boron content of from 0.032 to 0.045%. Alloys within said area could be expected to have a 1650° F impact strength of at least about 6 ft.-lbs. after 35,000 hours exposure at 1600° F and an 1800° F/16 ksi stress rupture life of at least 120 hours.

To provide the alloy with even better stress rupture properties, additions of small amounts of zirconium and/or rare earth metals can be made. Rare earth additions are generally in amounts of from 0.012 to 0.024%. Zirconium additions are generally in amounts of from 0.015 to 0.05%. Preferred zirconium levels are from 0.02 to 0.035%. Zirconium levels in excess of 0.1% are undesirable as excess zirconium may cause segregation of undesirable phases which, in turn, result in ingot cracking and/or decreased hot workability.

The following examples are illustrative of several aspects of the invention.

EXAMPLE I

Eight nickel base alloys (Alloys A through H) were heat treated as follows:

2135° F–4 hours–air cool
1975° F–4 hours–air cool
1550° F–24 hours–air cool
1400° F–16 hours–air cool and tested for stress rupture life at a temperature of 1800° F and a stress of 16 ksi. The aim chemistry of the alloys is as follows:

| Cr | Ti | Al | Co | Mo | W | C | B | Ni |
|---|---|---|---|---|---|---|---|---|
| 18.0 | 5.00 | 2.50 | 14.7 | 3.0 | 1.25 | * | * | Bal. |

*varied

Carbon and boron contents for the alloys appear hereinbelow in Table I.

TABLE I

| Alloy | Carbon (wt. %) | Boron (wt. %) |
|---|---|---|
| A | 0.007 | 0.016 |
| B | 0.014 | 0.034 |
| C | 0.015 | 0.031 |
| D | 0.020 | 0.048 |
| E | 0.020 | 0.062 |
| F | 0.019 | 0.084 |
| G | 0.035 | 0.048 |
| H | 0.033 | 0.033 |

The results of the stress rupture life test appear hereinbelow in Table II.

TABLE II

| Alloy | Stress Rupture Life (hours) |
|---|---|
| A | 77.2 |
| B | 105.5 |
| C | 119.3 |
| D | 124.7 |
| E | 92.9 |
| F | 88.0 |
| G | 122.3 |
| H | 107.9 |

The criticality of a boron content of from 0.031 to 0.048% is apparent from Tables I and II. Each alloy with a boron content within said range had a stress rupture life in excess of 100 hours, whereas the alloys with higher and lower boron contents had stress rupture lives of less than 100 hours. For comparison purposes, it is noted that alloy A with 0.016% boron and a carbon content of 0.007%, had a stress rupture life of only 77.2 hours; whereas alloy B with 0.034% boron and a carbon content of 0.014%, had a stress rupture life of 105.5 hours. Moreover, it is noted that alloy D with 0.048% boron and a carbon content of 0.020%, had a stress rupture life of 124.7 hours; whereas alloy E with 0.062% boron and a carbon content of 0.020%, had a stress rupture life of only 92.9 hours. Alloys within the subject invention have an 1800° F/16 ksi stress rupture life of at least 100 hours.

EXAMPLE II

Two additional nickel base alloys (Alloys B′ and H′) were heat treated as were Alloys A through H. The alloys were melted with the same aim chemistry as were alloys B and H, with the exception that Alloys B′ and H′ had zirconium added thereto. The carbon, boron and zirconium contents of Alloys B, B′ and H and H′ appear hereinbelow in Table III.

TABLE III

| Alloy | Carbon (wt. %) | Boron (wt. %) | Zirconium (wt. %) |
|---|---|---|---|
| B | 0.014 | 0.034 | — |
| B′ | 0.009 | 0.035 | 0.03 |
| H | 0.033 | 0.033 | — |
| H′ | 0.041 | 0.033 | 0.03 |

Alloys B′ and H′ were tested for stress rupture life as were alloys B and H. The results of the test appear hereinbelow in Table IV, along with the results for Alloys B and H (reproduced from Table II).

TABLE IV

| Alloy | Stress Rupture Life (Hours) |
|---|---|
| B | 105.5 |
| B′ | 115.8 |
| H | 107.9 |
| H′ | 125.0 |

From Table IV, it is apparent that zirconium improves the stress rupture properties of alloys within the subject invention. A zirconium addition of 0.03% increased the respective stress rupture lives of Alloys B and H from 105.5 and 107.9 hours to 115.8 and 125.0 hours. As noted hereinabove, in a specific embodiment the subject invention has from 0.015 to 0.05% zirconium, and preferably from 0.02 to 0.035%.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. A gamma prime strengthened nickel base alloy consisting essentially of, by weight, from 12.0 to 20.0% chromium, from 4.0 to 7.0% titanium, from 1.2 to 3.5% aluminum, from 12.0 to 20.0% cobalt, from 2.0 to 4.0% molybdenum, from 0.5 to 2.5% tungsten, from 0.031 to 0.048% boron, from 0.005 to 0.045% carbon, up to 0.75% manganese, up to 0.5% silicon, up to 1.5% hafnium, up to 0.1% zirconium, up to 1.0% iron, up to 0.2% of rare earth elements that will not lower the incipient melting temperature below the solvus temperature of the gamma prime present in the alloy, up to 0.1% of elements from the group consisting of magnesium, calcium, strontium and barium, up to 6.0% of elements from the group consisting of rhenium and ruthenium, balance essentially nickel; said titanium plus said aluminum content being from 6.0 to 9.0%; said titanium and aluminum being present in a titanium to aluminum ratio of from 1.75:1 to 3.5:1; said alloy being substantially free of deleterious acicular, sigma and mu phases; said gamma prime being characterized as gamma prime which is substantially speroidal; said alloy being characterized by a highly desirable combination of hot corrosion resistance, strength, creep resistance, phase stability and stress rupture life; said desirable combination of properties being, in part, attributable to said boron content of from 0.031 to 0.048%.

2. A nickel base alloy according to claim 1, having from 0.032 to 0.045% boron.

3. A nickel base alloy according to claim 1, having from 0.01 to 0.04% carbon.

4. A nickel base alloy according to claim 1, having from 0.015 to 0.05% zirconium.

5. A nickel base alloy according to claim 4, having from 0.02 to 0.035% zirconium.

6. A nickel base alloy according to claim 1, having from 0.032 to 0.045% boron and from 0.02 to 0.04% carbon; said alloy additionally having a 1650° F impact strength of at least 6 ft.-lbs. after 35,000 hours exposure at 1600° F and an 1800° F/16 ksi stress rupture life at least 120 hours.

7. A nickel base alloy according to claim 6, having from 0.015 of 0.05% zirconium.

8. A nickel base alloy according to claim 7, having from 0.02 to 0.035% zirconium.

* * * * *